US007144014B2

(12) United States Patent
Schaub, Jr.

(10) Patent No.: US 7,144,014 B2
(45) Date of Patent: Dec. 5, 2006

(54) PORTABLE KICKING GAME

(76) Inventor: Wayne W. Schaub, Jr., 5812 Argonne Blvd., New Orleans, LA (US) 70124-3732

( * ) Notice: Subject to any disclaimer, the term of this patent is extended or adjusted under 35 U.S.C. 154(b) by 37 days.

(21) Appl. No.: 10/940,999

(22) Filed: Sep. 15, 2004

(65) Prior Publication Data

US 2006/0055115 A1 Mar. 16, 2006

(51) Int. Cl.
*A63B 67/00* (2006.01)

(52) U.S. Cl. ..... 273/317.5

(58) Field of Classification Search ..... 273/317.5, 273/440, 441, 446; 473/470, 438, 415
See application file for complete search history.

(56) References Cited

U.S. PATENT DOCUMENTS

| | | | | |
|---|---|---|---|---|
| 1,663,404 | A * | 3/1928 | Hands | 273/317.5 |
| 3,642,285 | A * | 2/1972 | Impastato | 273/243 |
| 4,284,277 | A | 8/1981 | Leonard et al. | |
| 4,352,497 | A | 10/1982 | Warehime | |
| 4,355,813 | A | 10/1982 | Rathjen | |
| 4,687,208 | A | 8/1987 | Thomas | |
| 4,733,867 | A * | 3/1988 | Kemp et al. | 273/317.5 |
| 4,762,323 | A * | 8/1988 | Blagg | 273/126 R |
| 4,911,443 | A | 3/1990 | Foster | |
| 5,207,433 | A | 5/1993 | Moore | |
| 5,570,888 | A * | 11/1996 | Robinson et al. | 273/317.5 |
| 5,673,912 | A * | 10/1997 | Bonk | 273/108.4 |
| 5,687,966 | A * | 11/1997 | Barnhart et al. | 273/108.1 |
| 6,045,466 | A | 4/2000 | Suess | |
| 6,149,529 | A | 11/2000 | Fowler et al. | |
| 6,312,348 | B1 | 11/2001 | Sandell | |
| 6,386,997 | B1 | 5/2002 | Brown | |
| 6,439,575 | B1 * | 8/2002 | Castellanos | 273/317.5 |
| 6,503,159 | B1 | 1/2003 | Pehr | |
| 6,514,160 | B1 | 2/2003 | Cooper | |
| 2002/0137580 | A1 | 9/2002 | Hodge et al. | |
| 2002/0183139 | A1 | 12/2002 | Pehr | |
| 2003/0203774 | A1 | 10/2003 | Pettey | |
| 2004/0018897 | A1 | 1/2004 | Nelson | |
| 2004/0072635 | A1 | 4/2004 | Clark | |
| 2004/0121863 | A1 | 6/2004 | Liberfarb | |

FOREIGN PATENT DOCUMENTS

| | | |
|---|---|---|
| WO | WO 89/02770 | 4/1989 |

* cited by examiner

*Primary Examiner*—Raleigh W. Chiu
(74) *Attorney, Agent, or Firm*—Richard C. Litman

(57) ABSTRACT

The portable kicking game includes a relatively small, portable playing sheet or mat having a representation of a playing field thereon. The playing sheet is preferably sufficiently small to provide for placement in a medium size room, a single parking space in a stadium parking lot, etc. A small, portable goal post assembly and a kicking object are also provided. The kicking object may be in the form of a ball, polyhedron, or other shape as desired. Both the kicking object and goal post assembly may be formed of lightweight plastic, foam plastic material, or as inflatable devices, as desired. The game is played by alternately kicking the kicking object toward the opposite goal or through the goal post assembly with points awarded for successful kicks, in accordance with the rules of U.S. football or international soccer, as desired.

8 Claims, 4 Drawing Sheets

PORTABLE KICKING GAME

BACKGROUND OF THE INVENTION

1. Field of the Invention

The present invention relates to physical games and sports. More particularly, the present invention relates to a game which may be used to simulate certain aspects of American football, soccer, and other field games wherein kicking a ball or other object plays a part. The present game is a small-scale game played on a portable mat or sheet which is marked with certain kicking and scoring zones in accordance with the rules of play.

2. Description of the Related Art

A number of different physical games are known which involve kicking a ball or similar object into or through a goal, at least during certain conditions of play. In the U.S., American football is the best known of such games, with international soccer gaining in recognition. While such games may be exciting and entertaining to watch and to play, the play of such games is limited by the relatively small number of fields where they may be played due to the relatively large area required for play of the real game.

Such games were originally universally played outdoors, and as a result various indoor games and enclosed stadiums for play of football, soccer, and similar games have been constructed. However, all of these games when played on a professional or major amateur league level, still utilize quite large fields for play and are most certainly not portable. The rules of play for such games have evolved over time to require relatively large fields of play in order to increase the difficulty of scoring, and further to accommodate the relatively fast speed and great distances covered by the relatively hard and dense balls which are used in the play of such games.

Various attempts have been made in the past to produce simulations of various large scale ball games, with such simulations generally involving a relatively small tabletop game board, playing pieces moved on the board, and dice and/or cards to determine movement. Such games are clearly not physically taxing, and do not at all simulate the physical effort involved in the real game. While rules for other physical activities have been developed which require less space to simulate some of the activities and plays required of football, soccer, and similar games, those rules nearly universally require a permanent facility, and do not provide any means of scoring or competition between participants.

The present portable kicking game serves to bridge the gap between full-scale football, soccer, and related games involving kicking, and smaller scale practice systems and board games which do not simulate the physical actions involved in such full-scale games. The present portable kicking game comprises a mat or playing surface having a simulated playing field marked thereon, with various areas indicated for placement of the ball or other kicking object and various scoring areas indicated thereon. A single small standing goal is provided which may be quickly and easily moved from one end of the playing surface to the other, depending upon the need in accordance with the rules of play. A very soft, lightweight ball or other kicking object is provided for use in the play of the present kicking game. The present game may be set up in a matter of a minute or two for use as a party game, an indoor activity in a medium size room on a rainy day, or perhaps as a pregame tailgate party activity. Scoring is achieved in accordance with the accuracy and placement of the kicked ball or kicking object, with the end of the game being determined by a predetermined score or time being reached, as desired.

A discussion of the related art of which the present inventor is aware, and its differences and distinctions from the related invention, is provided below.

U.S. Pat. No. 4,284,277 issued on, Aug. 18, 1981 to David J. Leonard et al., titled "Kick Ball Game And Apparatus Kit Therefor," describes a full size playing field (i.e., on the order of one hundred to two hundred feet in length and fifty to one hundred feet wide). The permanent playing field is surrounded by a fence in order to keep the ball in play and to serve as a surface from which the ball may be rebounded as desired. The Leonard et al. game may have rules simulating soccer or hockey; no aspects of American football are disclosed. In contrast, the present portable game utilizes a playing surface on the order of seven feet long and four feet wide, i.e., small enough to be positioned in a single parking space for a stadium tailgate party or the like. The ball or kicking object used in the play of the present game is relatively lightweight, and is incapable of carrying very far when kicked. While the present game is directed primarily toward children, it can also be played by adults. The present game is directed particularly toward the kicking aspects of American football, but is readily adaptable to simulate soccer without any changes to the playing surface.

U.S. Pat. No. 4,352,497 issued on Oct. 5, 1982 to Norwood R. Warehime, titled "Football (Soccer) Game With Mobile Goals," describes several embodiments of tether balls tethered together and placed to define goals on a permanent playing field or site. Warehime specifies that the field should be at least thirty yards square, i.e., ninety feet by ninety feet. No portable playing surface having various kicking and scoring zones defined thereon, is provided by Warehime. Moreover, the tether anchors used by Warehime are either driven into the underlying surface, or comprise heavy bases which are not easily moved. None of the structure of the present game is heavy or weighted, in order to prevent injury to players if they inadvertently strike the upright goal assembly or other component of the present game, and also to facilitate the setup, takedown, transport, and storage of the present game.

U.S. Pat. No. 4,355,813 issued on Oct. 26, 1982 to Daniel J. Rathjen, titled "Playing Field Layout," describes a permanent field for the play of a flying disc (i.e., Frisbee®) game. The field is quite large, i.e., twenty-five by forty yards, and has a raised central area from which the discs are to be skipped on each toss. No kicking of any object is involved in the Rathjen field layout or game.

U.S. Pat. No. 4,687,208 issued on Aug. 18, 1987 to Squire J. Thomas, titled "Court Ball Game," describes a tossing game using a relatively soft ball. The object is to bounce the ball off of various fixed targets in the playing area, aiming so the bounce causes the ball to strike another object in the playing area. All tosses are accomplished from the end or edge of the field; players do not play on the field. The field is a permanent, relatively large area of about eighteen by thirty-one feet, including the end and side walking lanes. No kicking of any object toward, through, or over goal areas at each end of the field, is disclosed by Thomas.

U.S. Pat. No. 4,911,443 issued on Mar. 27, 1990 to James F. Foster, titled "Football Game System And Method Of Play," describes a game utilizing American football rules, but having a field only two hundred feet long by eighty feet wide. Resilient nets are set up to each side of each goal post, to cause a ball not passing between the goal posts to rebound back onto the playing field where it remains in play. While smaller than a conventional football field, the Foster playing area is still considerably larger than the portable playing mat or surface used with the present game. Foster does not disclose a field layout or rules resembling the present portable kicking game.

U.S. Pat. No. 5,207,433 issued on May 4, 1993 to Robert A. Moore, titled "Football Game, Apparatus And Method Of Play," describes a game using a permanent field of at least forty yards long and thirty yards wide. A series of nets are placed on the field to act as target receptacles for the ball when it is passed. No kicking is involved in the Moore game, which is directed only to the passing aspects of U.S. football.

U.S. Pat. No. 6,045,466 issued on Apr. 4, 2000 to Richard F. Suess, titled "Football Game For Reduced Size Playing Areas, Especially Indoor Playing Areas," describes a football game using a permanent playing field of about sixty percent the size of a conventional football field in order for the game to be played within other indoor arenas such as hockey or possibly even basketball arenas. Suess also provides one or more nets above the center of the field, to deflect extremely high passes and kicks. Only eight players are used to form a team, rather than the conventional eleven players used for standard football. Otherwise, essentially traditional football rules are used by Suess. The large, permanent playing field, eight players per team, use of a conventional football, and use of essentially conventional football rules are all different from the present inventive game.

U.S. Pat. No. 6,149,529 issued on Nov. 21, 2000 to William L. Fowler, titled "Combination Football And Skating Game With Enclosed Ramp Field And Different Scoring Zones," describes a football-like game played in a large, permanent field having a bowl-like configuration. Players play on in-line skates, using the upwardly curved sides of the field during play. Kicking is obviously precluded in the Fowler game, due to the use of skates by the players.

U.S. Pat. No. 6,312,348 issued on Nov. 6, 2001 to Timo A. Sandell, titled "Playing Field With Equipment For A Football-Like Game," describes a game generally following the rules of international soccer but incorporating two goals at each end of the field, i.e., having a total of four goals. Sandell states that his playing field and game complies with the rules governing the dimensions of the field and goal structures used in international soccer. Accordingly, the Sandell field structure and game are not portable and do not use a small, folding ground sheet upon which the game may be played, as provided by the present portable kicking game invention.

U.S. Pat. No. 6,386,997 issued on May 14, 2002 to Kenneth M. Brown, titled "Ultimate Ring Toss Game," describes a ring or quoit toss game played on a relatively large permanent field of at least fifty-five yards by thirty yards, or larger, depending upon the number of players. No kicking is involved in the Brown ring toss game.

U.S. patent Publication No. 2002/137,580 published on Sep. 26, 2002 and applied for by Tracy G. Hodge et al., titled "Field Game," describes a kicking game which combines aspects of American football and international soccer. A large, permanent field is used, with the field having a length of eighty yards between the two permanent goals. Play is much like that used in soccer, with the ball being kicked during play. The goals each have a lower and a higher level, with a greater score being awarded for a kick through the more heavily guarded lower portion. The large, permanent field with its two level permanently installed goals and the relatively large number of players, differ considerably from the present kicking game.

U.S. patent Publication No. 2002/183,139, published on Dec. 5, 2002 and applied for by Harold T. Pehr, titled "Football Game Method Of Play," describes a modification of conventional football rules to provide a greater score for successful field goals kicked from greater distances. The Pehr rule modification otherwise requires a conventional large, permanently installed football field for play, with a game having eleven players per team in play.

U.S. Pat. No. 6,503,159 issued on Jan. 7, 2003 to Harold T. Pehr, titled "Football Game," is the issued U.S. patent from the '139 U.S. patent Publication discussed immediately above. The same points noted in that discussion are seen to apply here as well.

U.S. Pat. No. 6,514,160 issued on Feb. 4, 2003 to John M. Cooper, titled "Ball Game," describes a game combining elements of squash and soccer. The game is played in a completely enclosed court, with a rebound wall at one end and only one goal opposite the rebound wall. Two opposing multiple player teams attempt to kick the ball into the goal, either from a rebound or directly. The playing court is a permanent structure, with nets and walls to keep the ball in play at all times.

U.S. patent Publication No. 2003/203,774 published on Oct. 30, 2003 and applied for by Philip E. Pettey, titled "Sport Game," describes a game utilizing a large, permanently established playing field of one hundred sixty feet in width by one hundred twenty feet long. Two playing objects (hockey pucks, footballs, etc.) are in play simultaneously. The rules described are rather general, but essentially result in two simultaneous scoring attempt drives during play. The game emphasizes passing, e.g., by hand in the case of football, with little emphasis on kicking, unlike the present portable kicking game.

U.S. patent Publication No. 2004/18,897 published on Jan. 29, 2004 and applied for by Jeffrey A. Nelson, titled "Soccer (Or Association Football) Goalkeeping Game," describes a two player goaltending game or practice primarily directed to improving soccer skills. The game is played on a relatively large, permanent field of twenty-two by twenty-four yards, with a conventional soccer goal at each end. The rules more closely resemble those for soccer, rather than for U.S. football.

U.S. patent Publication No. 2004/72,635 published on Apr. 15, 2004 and applied for by Harvey P. Clark, titled "Game Combining Strategy And Ball Kicking Skills," describes a game having a net divided into a three by three matrix of nine net compartments. The object of the game is to kick the ball into one of the nine compartments as desired to form a lateral, vertical, or diagonal row in the manner of the game of tic-tac-toe. No means of advancing the ball or other kicking object along the length of a playing field toward one of two opposed goals, is provided by the Clark game.

U.S. patent Publication No. 2004/121,863 published on Jun. 24, 2004 and applied for by Sidney Liberfarb, titled "Pass And Kick Football," describes a game quite similar to conventional U.S. football, but with modifications to the rules to prevent hard contact between players to provide a safer game for players. Kicking and field goal attempts are still part of the Liberfarb game, but the ball is not advanced down the field by kicking per se, as in the present game. In any event, the Liberfarb game is played upon a permanent playing field, unlike the present portable kicking game.

Finally, International patent Publication No. WO89/2770 published on Apr. 6, 1989, titled "Football Game System," is the PCT filing of the '443 U.S. patent to the same inventor, discussed further above. The same points noted in that discussion are seen to apply here as well.

None of the above inventions and patents, taken either singly or in combination, is seen to describe the instant invention as claimed. Thus a portable kicking game solving the aforementioned problems is desired.

SUMMARY OF THE INVENTION

The present portable kicking game bridges the gap between games requiring great athletic strength and skill, e.g., football and soccer, and board games having rules which simulate those athletic games. The present game is played on a relatively small, portable mat or sheet which is marked or imprinted with a playing field layout or pattern. A small, portable goal post assembly is provided, which goal post may be quickly and easily switched from one end of the playing sheet to the other as required. A kicking object, e.g., a ball, a polyhedron, etc., is also provided. The playing surface is quickly and easily rolled or folded for storage and deployed as desired, while the goal post assembly is also quickly assembled or disassembled as needed. The goal post assembly and kicking object may be formed of lightweight plastic material, foam plastic, or may be inflatable as desired.

The present game is played by laying out the playing surface on any suitable supporting surface, e.g., a stadium parking lot, a backyard, a medium size room, etc. Two players or teams are selected, and the order of play is determined (e.g., by a coin toss, etc.). The kicking object is placed on one of the goal lines, and the selected player kicks the kicking object toward the opposite goal line. The object of the game is to kick the kicking object so that it comes to rest completely within the opposite scoring zone (end zone) from the starting point. Each player gets one kick, in alternating order. If multiple player teams have been selected, the teams alternate turns, with turns rotating throughout each team. Opposing players or teams kick the kicking object back toward the opposite scoring zone from wherever the object comes to rest from the previous kick by the opposite player or team, until a score is achieved.

When such a score has been made, the goal post assembly may be placed in position on the back edge of the scoring zone and the kicking object placed in the center of the layout, so the player may attempt a conversion. Alternatively, an attempt at a two point conversion may be made by kicking the kicking object toward the opposite scoring zone from the central zone.

A player may kick the object into the central scoring attempt zone during play, and make a second consecutive kick at an attempt at a field goal over or through the goal post assembly. When this option is possible, the temporary goal post assembly is placed at the back of the opposite scoring zone (end zone), and the player attempts to kick the kicking object through or over the goal post assembly. The kicking object is placed in that scoring zone for the initial kick by the opposing player or team, after the field goal attempt has been completed.

Scoring may be in accordance with conventional football rules, i.e., six points for a "touchdown," where the kicking object comes to rest completely within the opposite end zone. One or two points for conversion may be awarded for a successful kick over or through the goal post assembly, or into the end zone. Three points may be awarded for a successful field goal attempt over or through the goal post assembly. Alternatively, the goal post assembly may be used to designate a goal cage, as in the game of soccer, with a single point awarded for a successful kick into the goal. These rules of play and scoring may be modified as desired, to provide better scoring opportunities for younger players and/or to balance inequities in the skill levels between different players or teams. Other rules may be provided to govern out-of-bounds situations, etc., as desired. The end of the game may be determined by reaching a predetermined total score, or score by one player or team, or by reaching a predetermined time limit, as desired.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a kicking game, with both the apparatus and methods of play of the present game providing a loose simulation of other, more athletic games played on larger, permanent facilities. The present game most closely resembles some of the kicking aspects of the game of American football, but may also be played as a single player version of other kicking games, such as soccer, rugby, etc., or even such games as field hockey or lacrosse, with kicking being used to move the object about the field of play.

Figure 1:
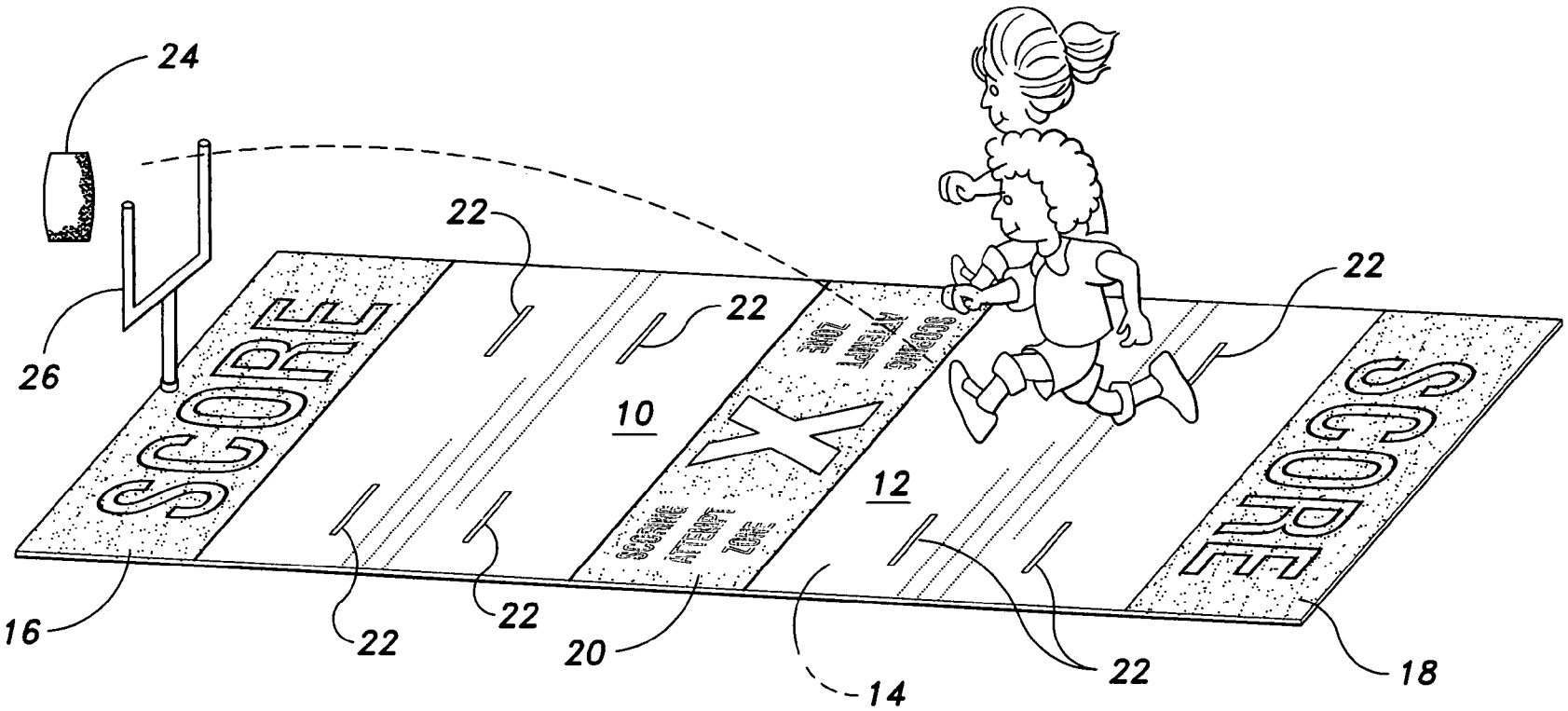
FIG. 1 is an environmental, perspective view of a portable kicking game according to the present invention, showing its general features and use.
Figure 2:
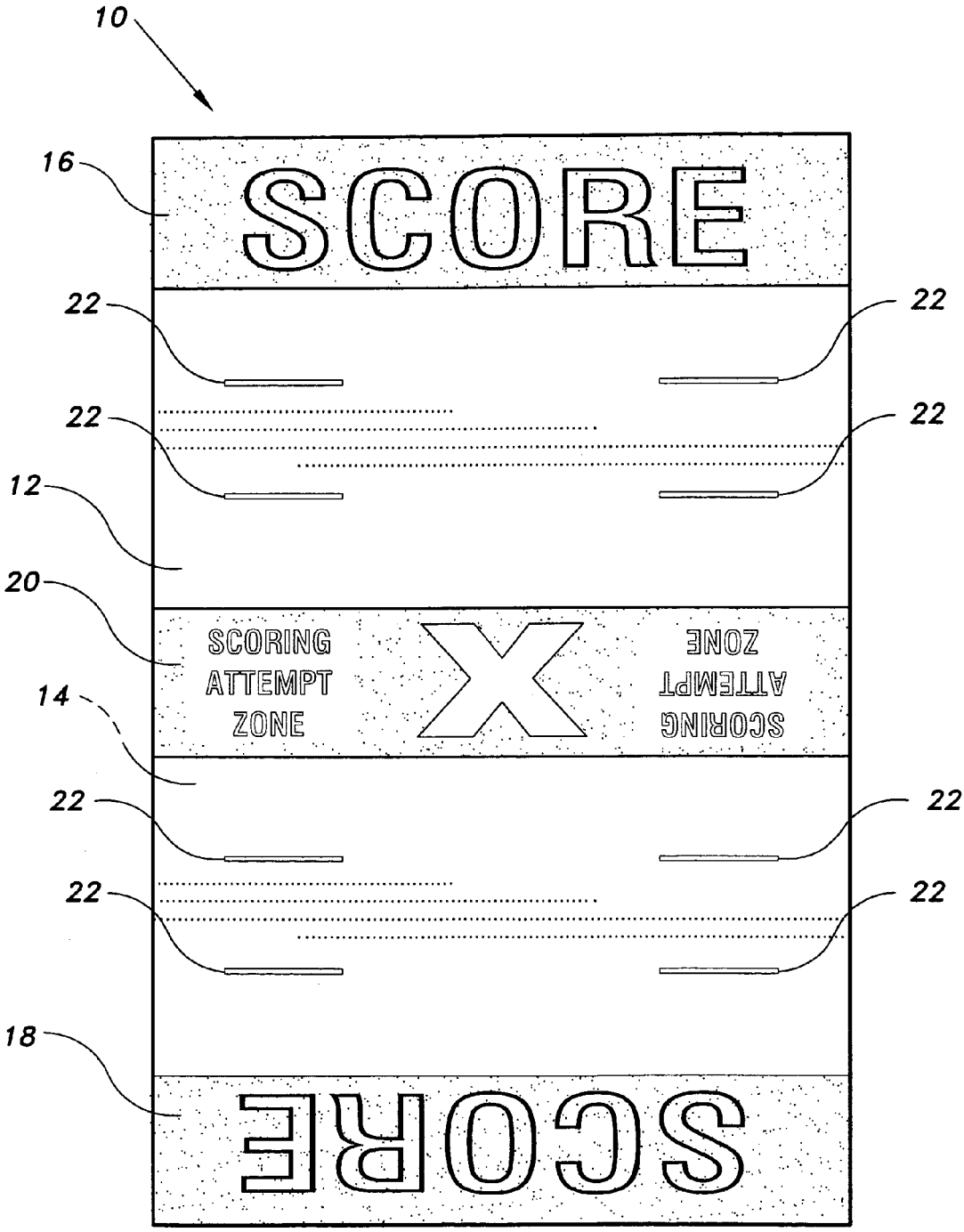
FIG. 2 is a top plan view of the playing sheet or surface used with the present game, showing further details thereof.

FIG. 1 provides an environmental perspective view of the present kicking game and its various components, with FIG. 2 providing a top plan view of the portable playing surface and the playing field representation thereon. The playing surface comprises a thin, flexible, and portable ground sheet 10, formed of plastic or other suitable material. A representation of an athletic playing field 12, e.g., football or soccer field, etc., is disposed upon the upper surface of the ground sheet 10. Preferably, the opposite lower or bottom surface 14 has a high friction surface, in order to preclude slippage or movement of the ground sheet 10 during play.

The size of the ground sheet 10 is somewhat variable, depending upon the area of intended use and the size, strength, and skill of the intended players as well as the characteristics of the kicking object used. For smaller children, a size of about seven feet long by four feet wide has been found to work well in testing, but the ground sheet 10 may be enlarged as desired. A conventional tarp or the like could be used for the ground sheet, so long as it includes the athletic playing field layout on its upper surface and the preferred non-skid bottom surface. The ground sheet 10 is relatively thin, and thus may be easily folded or rolled to a compact volume for storage when not in use. The ability of the ground sheet or playing surface 10 to be folded, permits larger sheets 10 to be folded laterally between either or both of the scoring zones and the medial scoring attempt zone (these zones are described below) and/or lengthwise to narrow the sheet 10, to adjust the playing field size for younger and/or less skilled players, if so desired.

The athletic playing field layout 12 of the ground sheet 10 includes a first score zone 16 at one end of the ground sheet, a second score zone 18 at the opposite end of the ground sheet, and a medially positioned scoring attempt zone 20 between the two end score zones 16 and 18. A series of evenly spaced hash marks or yard markers 22 may also be provided along the length of the field representation 12 between the first score zone 16, the medial scoring attempt zone 20, and the second score zone 18. The hash marks 22 may be spaced as desired, not necessarily one yard apart, depending upon the overall size of the ground sheet 10. The functions of these various zones and markers are explained further below.

The present kicking game also includes a kicking object 24. The kicking object 24 is not necessarily spherical in shape, but may be formed as a polyhedron with one or more oblate sides or surfaces, as shown. Other shapes and configurations may be used as desired. Preferably, the kicking object 24 is formed of a resilient foam plastic material to provide the lightweight and low density desired. However, the kicking object 24 may be an inflatable device, if so desired. In any event, for smaller ground sheets 10, it is important that the kicking object not carry too far after even a vigorous kick. Accordingly, a relatively low density kicking object is desired, having a considerably lower weight for its surface area than a conventional football or soccer ball. Such a kicking object 24 has very little aerodynamic penetration when kicked, and rapidly "dies" to limit its flight to relatively short distances. Such characteristics also preclude damage to household objects when the present game is played indoors.

Perhaps most scoring in the present game is accomplished on the surface, i.e., kicking the kicking object 24 back and forth by alternate players until it reaches one of the end scoring zones 16 or 18. However, the present game also includes means for simulating a field goal or point after touchdown, as played in American football. A lightweight, portable, adjustably positionable goal assembly 26 is provided with the present game, with the goal assembly 26 being positioned as required at either end of the playing surface to serve as a target or goal for airborne kicks. The goal assembly 26 may be in the form of a conventional goal post, i.e., a single post having a crossbar and two opposed uprights extending upwardly therefrom, as shown in FIG. 1 of the drawings. Alternatively, the goal assembly 26 may comprise any of a number of other conventional configurations, e.g., a capital "H" shape with two posts and a crossmember therebetween, a closed polygonal shape atop a single or dual posts, etc. Where two support posts are used, the ground area between the two posts may be used as a soccer goal. Alternatively, the configuration illustrated in FIG. 1 could be inverted with the two uprights defining a soccer goal on the surface, if so desired. The goal assembly may be formed of a series of sections of plastic tubing, e.g., PVC pipe or the like, which are quickly and easily assembled for use and disassembled for storage. Other materials may be used as desired, e.g., lengths of foam pipe insulation for lightweight, cardboard or similar tubing, etc. Alternatively, the goal assembly may be formed as a pneumatically inflatable structure for even more compact storage, if so desired.

Figure 4:
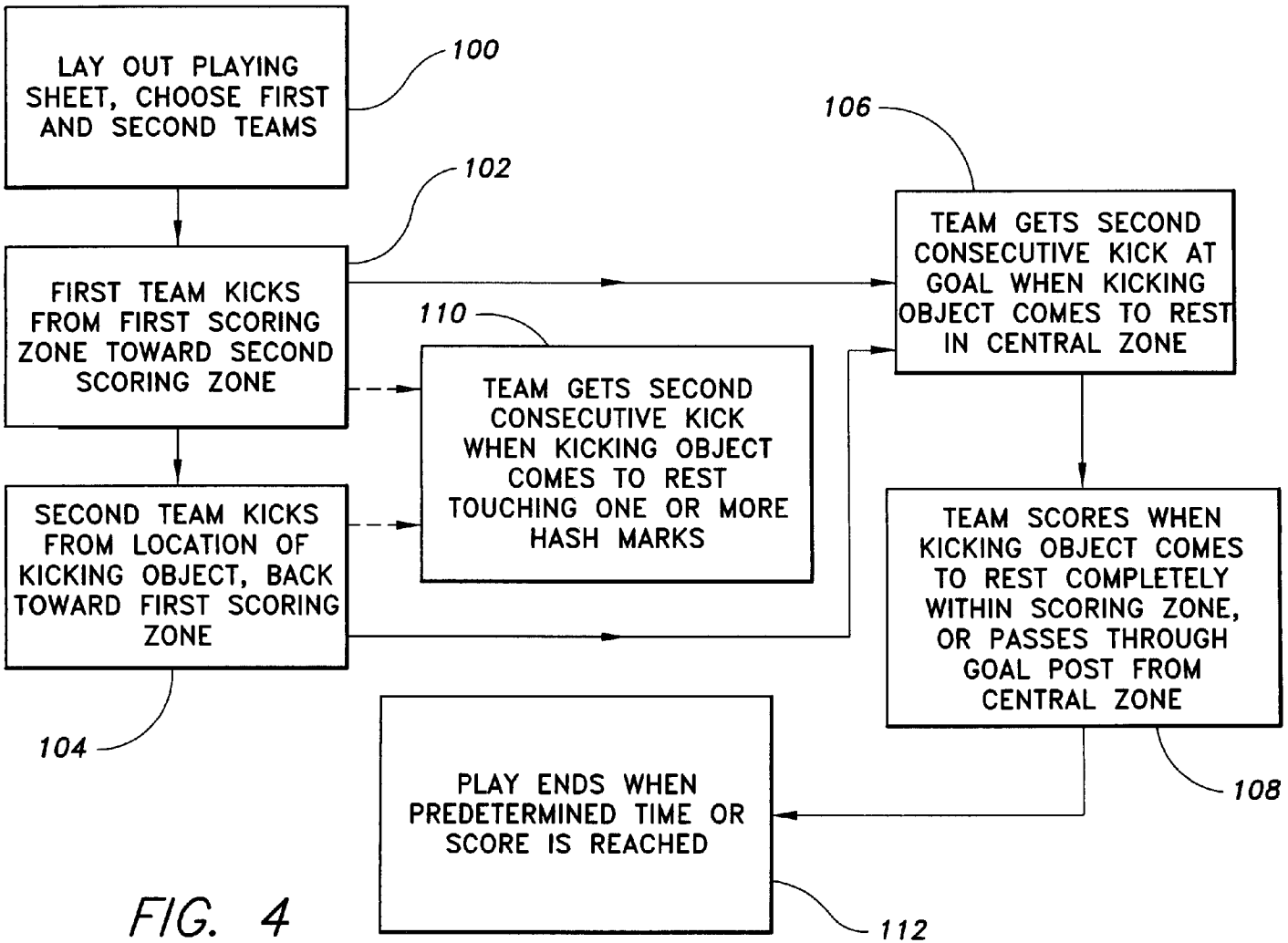
FIG. 4 is a flow chart describing the basic steps in the method of play of the present game.

FIG. 4 of the drawings provides a flow chart describing the basic steps in the method of play of the present kicking game. It should be noted that the flow chart of FIG. 4 covers only the basic rules of play of the present game, and that modifications or additions to these rules may be incorporated as described further below. The thin, flexible, portable ground sheet 10, with its relatively small dimensions, enables the present game to be set up and played virtually anywhere. The present kicking game is particularly well suited as a "tailgate party" activity at a football game or other sports event, as the relatively small size of the ground sheet 10 enables it to be laid out in a single parking space in a stadium parking lot or the like. The present game is also well suited as a game for small children at a birthday party or similar activity, and can even be played indoors as a rainy day activity, in a medium size or larger room. The game is set up by laying out the ground sheet 10 in a suitable location and assembling or inflating the goal post assembly 26, generally as indicated by the first step 100 of FIG. 4. The kicking object 24 is also inflated, if so required.

The players or teams are also selected at this point, with one player or team being designated as the first player or team and the other player or team designated as the second player or team. It should be understood that only a single person is on the playing surface 10 at a time in the present game, with an exception provided for a second player to hold the kicking object for a place kick. Team play is accomplished by allowing different players in a given team to take turns at kicking the kicking object, as the turn for that team comes up. The determination of first and second players and teams may be accomplished with a coin toss or other means as desired. The first player or team may choose to kick (which provides a chance at scoring, in the present game), or may choose which end of the field they wish to play from, with players or teams switching their direction of play at various points during the game, as in conventional American football.

Once the game has been set up and the order of play determined, the kicking object 24 is set up along the goal line of the appropriate scoring zone 16 or 18. The first player then kicks the kicking object 24, attempting to kick the object 24 into the opposite score zone, generally as indicated by the second step 102 of FIG. 4.

Generally, the first player will not be successful in his or her first attempt to kick the kicking object into the opposite end scoring zone to produce a score. The kicking object will generally end up at some point on the field of play 12, between the two score zones 16 and 18. When this occurs, the second player (or player from the second team) positions himself or herself facing back toward the goal upon which the kicking object was initially placed and kicks the kicking object 24 back toward its starting position, generally as indicated by the third step 104 of FIG. 4.

At times, the kicking object 24 may not remain entirely upon the playing surface of the ground sheet 10. When the kicking object comes to rest either partially or completely off the side of the playing surface 10, it is repositioned at the hash mark or yard marker 22 closest to the position where it went out of bounds. The opposite player or team then kicks the kicking object 24 from that location. Alternatively, the kicking object may be repositioned at the edge of the playing surface where it went out of bounds and played from that position, in the event that no hash marks are provided on the playing surface. If the kicking object 24 comes to rest partly or mostly within either of the end score zones 16 or 18, but extends beyond the extreme end of the score zone, it is considered to be out of bounds. The kicking object 24 is repositioned upon the closest hash mark 22 to the side of the end scoring zone 16 or 18 in which it became out of bounds, and the next player kicks the kicking object 24 from that point. The same procedure is applied if the kicking object 24 is kicked completely beyond either of the two end scoring zones 16 or 18.

Figure 3:
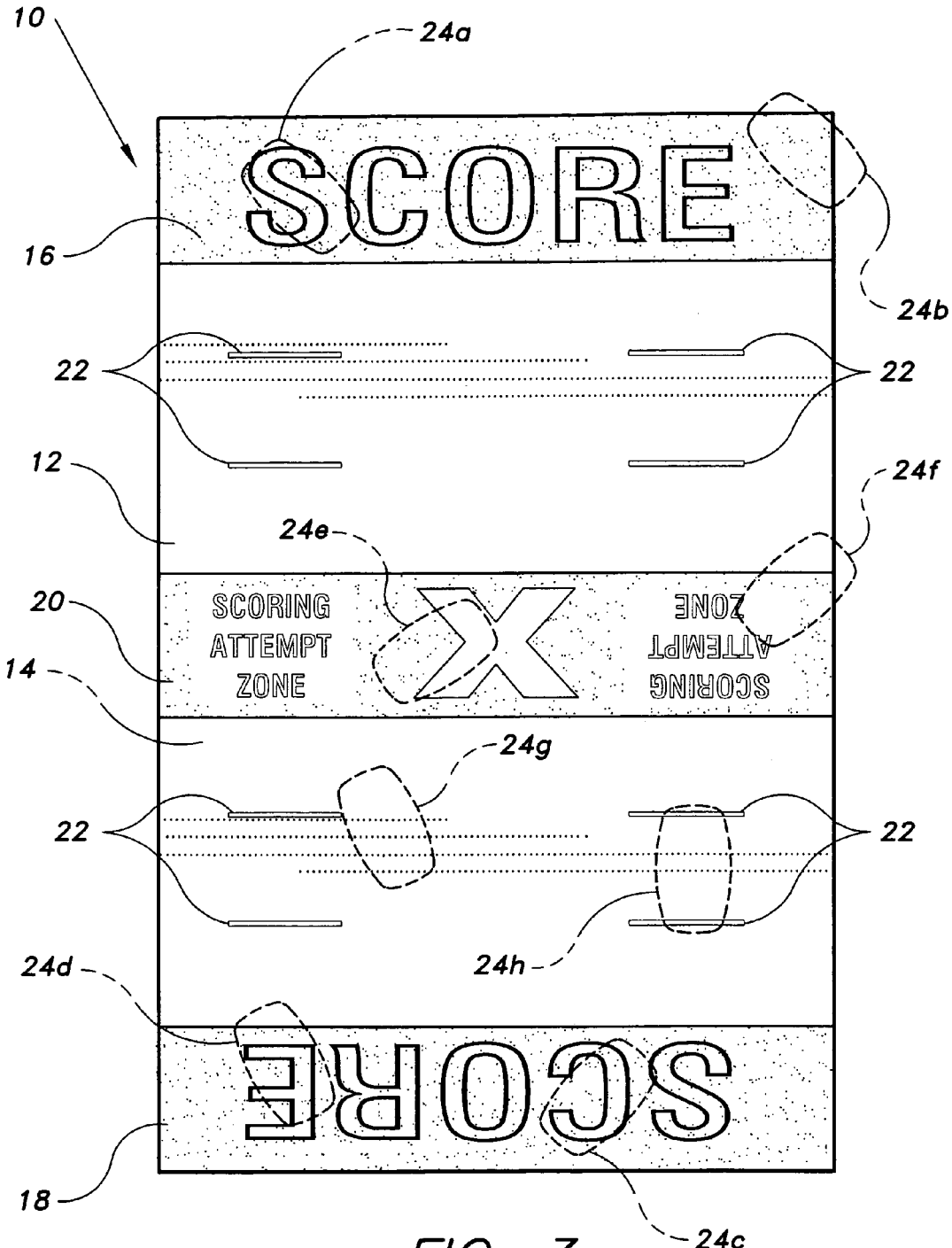
FIG. 3 is another top plan view of the playing sheet or surface, showing different exemplary positions of a kicking object thereon to define the scoring achieved by such positions.

Examples of in bounds and out of bounds positions for the kicking object are shown in FIG. 3 of the drawings. In a first example, the kicking object shown at location 24*a* is completely within the first end score zone 16. Such an end position would result in the awarding of a point or points for the kicking player or team, e.g., six points to simulate a touchdown in American football or perhaps a single point in a simulation of soccer, etc. However, the other kicking object location 24*b* in the scoring zone 16, is not completely within the scoring zone. Accordingly, it would be repositioned upon the nearest hash mark 22 to the end zone 16 at the side where it went out of bounds, or along the edge of the playing surface at an equivalent distance from the scoring zone 16 if no hash marks are provided on the playing surface.

Additional kicking object positions 24*c* and 24*d* are illustrated at the opposite end scoring zone 18 in FIG. 3. The kicking object location 24*c* is completely within the scoring zone 18 and would result in a score, just as in the case of the kicking object location 24*a* within the scoring zone 16 discussed further above. However, a kicking object represented at the location 24*d*, is not completely within the end scoring zone 18. As such, no score or points are awarded for such a result. The kicking object is repositioned upon the nearest hash mark 22 to the position 24*d* (or to the opposite side, if the kicking object comes to rest across the goal line on that side of the playing surface), for the opposite player or team to kick. Alternatively, the kicking object may be repositioned as described further above for the position 24*b* at some distance from the scoring zone and along the nearest side line, if no hash marks are provided.

Other kicking object locations 24*e* and 24*f* are shown on the medial scoring attempt zone 20 in FIG. 3. A kicking object 24*e* is illustrated in broken lines, completely within the scoring attempt zone. Such a position would allow the kicking player a second consecutive kick attempt at a field goal or free kick, after his or her initial kick resulted in the kicking object coming to rest completely within the scoring attempt zone 20 as shown by the example of 24*e*. However, if the kicking object extends beyond the scoring attempt zone 20, or out of bounds to the side, as shown by the kicking object 24*f* in FIG. 3, the kicking object is repositioned along the edge of the scoring attempt zone but in alignment with the row of hash marks adjacent to the side of the field upon which the out of bounds situation occurred (or at least repositioned to be completely in bounds, if no hash marks are provided), and play turns over to the opposite player or team. Alternatively, the kicking object could be relocated at the center of the playing surface along the edge of the medial scoring attempt area in such a situation, if so desired.

Oftentimes, a player may not kick the kicking object 24 more than about half way down the length of the playing surface 10. It may be easier for the next player to kick the object 24 a relatively short distance to the medial scoring attempt zone 20, than to kick the object 24 a greater distance with sufficient accuracy to come to rest completely within the end scoring zone 16 or 18. When the kicking object 24 comes to rest completely within the medial scoring attempt zone 20, as in the example of 24*e* in FIG. 3, the kicking player receives a second consecutive kick attempt to simulate a field goal (in American football) or a free kick (in soccer). The goal assembly 26 is placed upon the back of the appropriate score zone 16 or 18, i.e., at the extreme edge end of the ground sheet playing surface 10. The player then has one attempt to kick the kicking object over (as in American football) or through (as in soccer) the goal assembly 26. The kicking object 24 may be held by another player or team member to provide for a stable place kick for the kicking player. If successful, the player (or that player's team) is awarded three points when simulating American football, or a single point for soccer. Other point counts may be awarded in accordance with any agreements made before the game. This procedure is indicated generally by the fourth step 106 of FIG. 4. After the kick attempt, the kicking object is placed upon the goal line of the appropriate end score zone 16 or 18 for the opposing player or team to kick off as was done to begin the game.

Another alternative rule which may be implemented, is the allowance of a second consecutive kick for a player when the kicking object comes to rest touching one of the hash marks 22, as shown by the kicking object location 24*g* in FIG. 3. Alternatively, a more difficult rule may require that the kicking object be in simultaneous contact with two hash marks 22, as shown by the kicking object location 24*h* in FIG. 3. Depending upon the rules agreed upon before the beginning of the game, either of these possibilities may be provided for to allow a second consecutive kick for a player who achieves such a situation. This option is indicated by the optional sixth step 110 of FIG. 4.

Play continues as described above, until the kicking object is kicked completely into one of the two scoring zones 16 or 18 by the appropriate player. When this occurs, that player or team is awarded a predetermined number of points in accordance with the mutually agreed upon rules of the game, generally as indicated by the fifth step 108 of FIG. 4. In the case of a simulation of American football, such a score may be awarded six points, as in the case of a football touchdown. If soccer is being simulated, such a score is only awarded a single point.

When the present kicking game is used to simulate American football, provision is made for a point after touchdown attempt after the kicking object has been kicked to come to rest within one of the end score zones 16 or 18. When this occurs, the goal assembly 26 is placed at the extreme outer edge of the end score zone 16 or 18 in which the score was made, as described further above in positioning the goal assembly 26 for a field goal attempt. The scoring player places the kicking object 24 back at the center of the medial scoring attempt zone 20, and attempts to kick the kicking object 24 through the goal assembly 26. If successful, an extra point is awarded to the kicking player or to his or her team.

Alternatively, a two point conversion may be attempted after a "touchdown" in the present game. Rather than placing the goal assembly 26 at the appropriate end of the playing surface or ground sheet 10, the kicking player attempts to kick the kicking object 24 into the end scoring zone 16 or 18 from the medial scoring attempt zone 20. If successful, i.e., the kicking object 24 comes to rest in the appropriate end scoring zone 16 or 18 with no part extending beyond the boundaries of the score zone, two points are awarded to the player for a successful conversion after the six point touchdown score. The kicking object 24 is placed upon the goal line of the appropriate end score zone 16 or 18 for a kickoff by the opposing player or team, after any of the above described scores or conversion scoring attempts.

The game continues as described above, until the end of the game is reached. This may be determined by reaching a predetermined score, either total score or score differential between players or teams, or by reaching a predetermined time, either elapsed time for the game or real time, e.g., the beginning of the football game when the present kicking game is played during a pregame party. This step is indicated as the final seventh step 112 in the flow chart of FIG. 4. Players or teams may switch directions of play at quarter or half time game intervals or after reaching a predetermined score, as desired. This may prove particularly interesting when the present game is played outdoors in a wind, just as wind may affect the outcome of an actual football or soccer game.

While the present portable kicking game is relatively simple in its structure and method of play, a great many modifications to the rules may be provided as desired. Various rule modifications may be provided for one player or team over the opposite player or team, to "level the playing field" and remove some advantage that one player or team may have over the other. For example, when larger children or adults are playing against smaller children, the larger or adult players may be required to make all free kick and field goal attempts from their own end scoring zone toward the opposite scoring zone, rather than from the medial scoring attempt zone. This rule may be extended to require such older, more skilled players to kick from one corner of the playing surface rather than from the center, if so desired.

Smaller or less skilled players may have scores allowed when the kicking object is only partially within the scoring, zone, while older, larger, and/or more skilled players must get the kicking object completely within the scoring zone for the score to count. Another alternative is to allow second consecutive kicks for younger players when the kicking object comes to rest upon one or two of the hash marks, while removing this provision for the older and/or more skilled players. Younger, smaller, and/or less skilled players may also be allowed to move the kicking object to the center of the playing surface for scoring attempts, rather than being required to kick from an off center location.

In conclusion, the present portable kicking game in its various embodiments provides a novel and entertaining light physical activity for players. While the present kicking game may simulate various games involving kicking a ball or object toward a goal, e.g., soccer, it is particularly well suited for the simulation of American football. As such, the present game lends itself to play during pregame activities in the home environment or at tailgate parties and similar functions, as well as at children's birthday parties and similar activities. The portability of the present game, with its relatively light and foldable playing surface and compactly storable goal and kicking object, allows the apparatus of the present game to be carried and set up virtually anywhere in only a minute or so.

The rules of the present kicking game are relatively simple, and are easily understood by younger players as well as older players and adults. Yet, many modifications of the rules are permitted to remove any potential advantage which older and/or more skilled players may have. The size of the playing surface or ground sheet may be varied to provide greater or lesser challenge to players, as desired, and its flexible nature allows it to be folded to provide a shorter and/or narrower field, as desired. Accordingly, the present portable kicking game will prove to be a most enjoyable leisure activity for all who have an interest in the game.

It is to be understood that the present invention is not limited to the embodiments described above, but encompasses any and all embodiments within the scope of the following claims.

I claim:

1. A method of playing a portable kicking game, comprising the steps of:

(a) providing a thin, flexible, portable ground sheet having an upper surface and a lower surface;

(b) providing a representation of an athletic playing field upon said ground sheet upper surface, said athletic playing field representation including a first score zone, a second score zone opposite the first score zone, and a medially disposed scoring attempt zone therebetween, wherein the first score zone, the second score zone and the scoring attempt zone are substantially equal in shape and dimension;

(c) providing a high friction surface on said ground sheet lower surface;

(d) providing at least two rows of evenly spaced hash marks on said ground sheet between the first score zone, the scoring attempt zone, and the second score zone;

(e) providing at least one lightweight, portable, adjustably positionable goal assembly to be removably disposed at either end of the ground sheet;

(f) providing a soft, lightweight kicking object;

(g) laying out the ground sheet on a horizontal surface with the playing field representation facing upwardly and the high friction surface engaging the horizontal surface;

(h) determining the first and second players;

(i) positioning the kicking object upon the first score zone;

(j) kicking the kicking object toward the second score zone, by a first player;

(k) kicking the kicking object toward the first score zone from its resting point on the playing surface after the first player's kick, by a second player;

(l) continuing in accordance with steps (j) and (k), until the kicking object comes to rest completely within one of the score zones;

(m) awarding at least one point to the player whose kick resulted in the kicking object coming to rest completely within the score zone; and (n) continuing play in accordance with steps (i) through (m).

2. The method of claim 1, further including the steps of:

(a) kicking the kicking object to rest completely upon the medial scoring attempt zone, as it travels in a direction toward one of the score zones;

(b) temporarily erecting the goal assembly at the scoring zone in the direction of travel of the kicking object;

(c) kicking the kicking object toward the goal assembly, from the medial scoring attempt zone; and (d) awarding at least one point to the kicking player when the kicking object passes through the goal assembly after being kicked from the medial scoring attempt zone.

3. The method of playing the portable kicking game of claim 1, the method further comprising the step of awarding a second consecutive kick to a player when the kicking object comes to rest upon at least one of the hash marks after a first kick.

4. The method of playing the portable kicking game of claim 1, further including the steps of:

(a) awarding six points to the player whose kick resulted in the kicking object coming to rest completely within the score zone;

(b) temporarily erecting a goal assembly at the scoring zone where the kicking object came to rest;

(c) placing the kicking object in the medial scoring attempt zone;

(d) kicking the kicking object toward the goal assembly, from the medial scoring attempt zone; and (e) awarding one point to the kicking player when the kicking object passes through the goal assembly after being kicked from the medial scoring attempt zone.

5. The method of playing the portable kicking game in accordance with the method of claim 1, further including the steps of:

(a) awarding six points to the player whose kick resulted in the kicking object coming to rest completely within the score zone;

(b) placing the kicking object in the medial scoring attempt zone;

(c) kicking the kicking object toward the score zone from the medial scoring attempt zone, by the player whose kick resulted in the kicking object coming to rest completely within the score zone; and (e) awarding two points to the kicking player when the kicking object comes to rest completely within the score zone after being kicked from the medial scoring attempt zone.

6. The method of playing the portable kicking game of claim 1, further including the step of folding the ground sheet as desired to shorten at least one of its dimensions.

7. The method of playing the portable kicking game of claim 1, further including the step of ending the game when a predetermined score is reached.

8. The method of playing the portable kicking game of claim 1, further including the step of ending the game when a predetermined time is reached.

* * * * *